United States Patent [19]

Nakada et al.

[11] 4,223,584

[45] Sep. 23, 1980

[54] ELECTRONIC MUSICAL INSTRUMENT

[75] Inventors: Akira Nakada; Eiichiro Aoki; Akiyoshi Oya; Takatoshi Okumura; Yasuji Uchiyama; Eiichi Yamaga, all of Hamamatsu, Japan

[73] Assignee: Nippon Gakki Seizo Kabushiki Kaisha, Hamamatsu, Japan

[21] Appl. No.: 81

[22] Filed: Jan. 2, 1979

[30] Foreign Application Priority Data

Jan. 10, 1978 [JP] Japan ..... 53-1734

[51] Int. Cl.[3] ..... G10H 3/06

[52] U.S. Cl. ..... 84/1.17; 84/1.01; 84/1.26

[58] Field of Search ..... 84/1.01, 1.11, 1.17, 84/1.26, 341, 345, DIG. 2

[56] References Cited

U.S. PATENT DOCUMENTS

| | | | |
|---|---|---|---|
| 3,697,664 | 10/1972 | Hiyama | 84/1.17 |
| 3,803,338 | 4/1974 | Adachi | 84/1.17 |
| 3,823,246 | 7/1974 | Hebeisen et al. | 84/1.17 |
| 3,922,943 | 12/1975 | Niinomi | 84/1.17 |
| 4,147,085 | 4/1979 | Robinson et al. | 84/1.17 |

*Primary Examiner*—J. V. Truhe
*Assistant Examiner*—Forester W. Isen
*Attorney, Agent, or Firm*—Spensley, Horn, Jubas & Lubitz

[57] ABSTRACT

An electronic musical instrument is provided with an upper, a lower and a pedal keyboards and musical tone generating circuits dependently corresponding to respective keyboards and, in addition thereto, an auxiliary musical tone generating circuit which is independent of the keyboards and can be selectively coupled with a particular keyboard according to the designation by a keyboard selection switch. This auxiliary musical tone generating circuit produces tone signals having a particular tone color. Key codes for a selected one of the keyboards among key codes supplied by a channel assignment circuit are latched separately in the auxiliary circuit, and musical tones corresponding to the latched key codes are produced in this particular tone color. An envelope control circuit of the electronic musical instrument includes a detection circuit which detects switching of the keyboard selection switch and the amplitude envelope of a musical tone is temporarily cleared upon detection of the switching of the keyboard selection switch.

9 Claims, 10 Drawing Figures

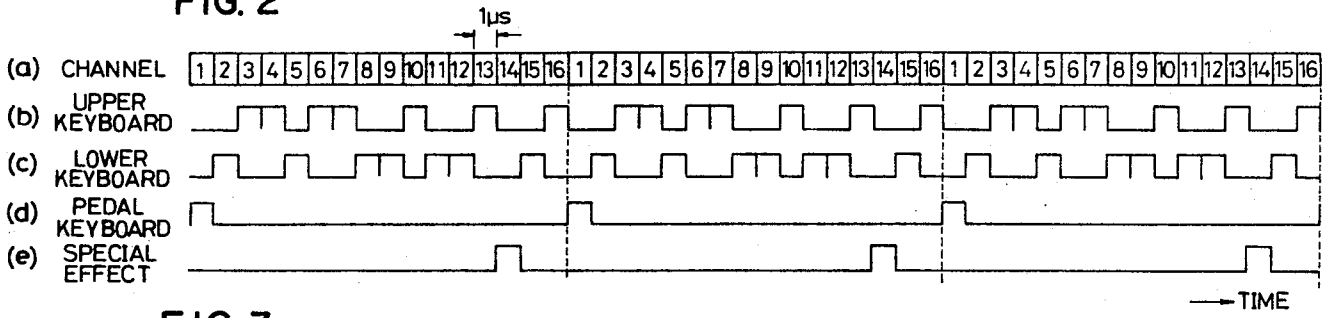

FIG. 3

| TIME SLOT | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| $KC_1$ | "1" | $B_1$ | $N_1$ | | $B_1$ | $N_1$ | | $B_1$ | $N_1$ | | $B_1$ | $N_1$ | | $B_1$ | $N_1$ | | $B_1$ | $N_1$ | | $B_1$ | $N_1$ | | $B_1$ | $N_1$ |
| $KC_2$ | "1" | $B_2$ | $N_2$ | | $B_2$ | $N_2$ | | $B_2$ | $N_2$ | | $B_2$ | $N_2$ | | $B_2$ | $N_2$ | | $B_2$ | $N_2$ | | $B_2$ | $N_2$ | | $B_2$ | $N_2$ |
| $KC_3$ | "1" | $B_3$ | $N_3$ | | $B_3$ | $N_3$ | | $B_3$ | $N_3$ | | $B_3$ | $N_3$ | | $B_3$ | $N_3$ | | $B_3$ | $N_3$ | | $B_3$ | $N_3$ | | $B_3$ | $N_3$ |
| $KC_4$ | "1" | $KO_1$ | $N_4$ | | $KO_1$ | $N_4$ | | $KO_1$ | $N_4$ | | $KO_1$ | $N_4$ | | $KO_1$ | $N_4$ | | $KO_1$ | $N_4$ | | $KO_1$ | $N_4$ | | $KO_1$ | $N_4$ |
| KEYBOARD | | P | | | U | | | U | | | U | | | U | | | U | | | U | | | U | |
| CHANNEL | | 1 | | | 4 | | | 7 | | | 10 | | | 13 | | | 16 | | | 3 | | | 6 | |

| TIME SLOT | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 |
|---|---|---|---|---|---|---|---|---|---|---|---|---|---|---|---|---|---|---|---|---|---|---|---|---|
| $KC_1$ | | $B_1$ | $N_1$ | | $B_1$ | $N_1$ | | $B_1$ | $N_1$ | | $B_1$ | $N_1$ | | $B_1$ | $N_1$ | | $B_1$ | $N_1$ | | $B_1$ | $N_1$ | | $B_1$ | $N_1$ |
| $KC_2$ | | $B_2$ | $N_2$ | | $B_2$ | $N_2$ | | $B_2$ | $N_2$ | | $B_2$ | $N_2$ | | $B_2$ | $N_2$ | | $B_2$ | $N_2$ | | $B_2$ | $N_2$ | | $B_2$ | $N_2$ |
| $KC_3$ | | $B_3$ | $N_3$ | | $B_3$ | $N_3$ | | $B_3$ | $N_3$ | | $B_3$ | $N_3$ | | $B_3$ | $N_3$ | | $B_3$ | $N_3$ | | $B_3$ | $N_3$ | | $B_3$ | $N_3$ |
| $KC_4$ | | $KO_1$ | $N_4$ | | $KO_1$ | $N_4$ | | $KO_1$ | $N_4$ | | $KO_1$ | $N_4$ | | $KO_1$ | $N_4$ | | $KO_1$ | $N_4$ | | $KO_1$ | $N_4$ | | | $N_4$ |
| KEYBOARD | | L | | | L | | | L | | | L | | | L | | | L | | | L | | ARP | | |
| CHANNEL | | 9 | | | 12 | | | 15 | | | 2 | | | 5 | | | 8 | | | 11 | | 14 | | |

TONE SOURCE CIRCUIT
NOTE SELECTING CIRCUIT
OCTAVE SELECTING CIRCUIT
KEYER
KEYER
KEYER
LATCH CIRCUITS
TONE GENERATOR
TONE GENERATOR
TONE GENERATOR
TONE COLOR FILTER
OUTPUT
ENVELOPE CONTROL CIRCUIT (FIG. 7)
DECODER (ROM)
KEY DATA DEMODULATING CIRCUIT (FIG. 5)
DISTRIBUTION CONTROL CIRCUIT (FIG. 5)
DAMP
SUS
U/L
CLR
ON
KC1
KC2
KC3
KC4

ELECTRONIC MUSICAL INSTRUMENT

BACKGROUND OF THE INVENTION

This invention relates to an electronic musical instrument in which a musical tone generating circuit which does not belong to any keyboard is provided so that it may be used commonly for any keyboard as required.

Normally, in a conventional electronic musical instrument, musical tone generating circuits are provides for respective keyboards so as to provide musical tones having tone colors which are different from one another depending upon the kind of keyboard. in other words, different musical tone generating circuits are provided for different keyboards, and, accordingly, when a key in a keyboard is depressed, a musical tone generating circuit provided for the keyboard produces a musical tone having a tone color peculiar to that keyboard.

A technique called "inter-keyboard coupler" is known in the art. In this technique, a musical tone generating circuit which belongs to one keyboard only as described above is driven by the key operation of another keyboards, so that the tones of the keyboard operated actually and the tones of the keyboard not actually operated are produced together. However, this "inter-keyboard coupler" has the difficulty that musical tones having all tone colors peculiar to the coupled keyboard are produced in response to the key operation on the actually operated keyboard and it is impossible to select a part of the tone colors; that is, by the key operation of keyboard, all the musical tone generating circuits for the coupled keyboard are driven.

For instance, a "coupler" in which musical tone generating circuits for an upper keyboard are driven by key operation of a lower keyboard will be described. If in this case a piano tone color and a clarinet tone color are selected for the upper keyboard and a flute tone color is selected for the lower keyboard, then tones having the piano tone color and clarinet tone color are produced by the key operation of the upper keyboard, and tones having the flute tone color, piano tone color and clarinet tone color (that is, both of the upper keyboard tones and the lower keyboard tones) are produced by the key operation of the lower keyboard. Thus, with the "inter-keyboard coupler", it is impossible to produce only tones having the piano tone color by the key operation of the upper keyboard and to produce only tones having the flute tone color and clarinet tone color by the operation of the lower keyboard.

SUMMARY OF THE INVENTION

In view of the foregoing, an object of this invention is to provide an electronic musical instrument in which in addition to usually provided musical tone generating circuits, a musical tone generating circuit which does not belong to any keyboard (that is, it is not provided fixedly for a certain keyboard) is provided and this additional musical tone generating circuit is used commonly for a plurality of keyboards.

For this purpose, a keyboard selecting switch is particularly provided to select a desired one out of the plurality of keyboards.

If this keyboard selecting switch is operated during the production of the tone of a key, the amplitude envelope of the previously depressed key remains in the additional musical tone generating circuit, which produces an undesirable irregular tone. In order to prevent the production of this undesirable tone, according to the invention a means is provided which, when the keyboard selecting switch is operated, operates to temporarily clear an envelope forming circuit (a tone keyer) in the additional musical tone generating circuit. This is an important feature of the present invention.

BRIEF DESCRIPTION OF THE DRAWINGS

In the accompanying drawings:

FIG. 2 is a timing chart indicating relations of tone production channels and respective keyboards;

FIG. 3 is a diagram indicating the multiplexing of key codes, etc. in a data multiplexing circuit shown in FIG. 1;

DETAILED DESCRIPTION OF THE INVENTION

Figure 1:
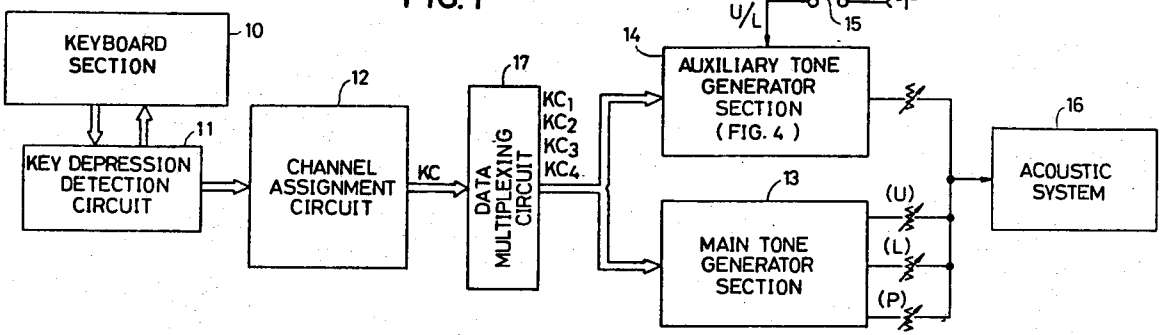
FIG. 1 is a block diagram showing one example of a digital processing type electronic musical instrument to which the technical concept of this invention is applied.

FIG. 1 shows a preferred example of an electronic musical instrument according to this invention, which comprises: a keyboard section 10; a key depression detection circuit 11; a channel assignment circuit 12; a main tone generator section 13; an auxiliary tone generator section 14; an acoustic system 16; and a data multiplexing circuit 17.

The keyboard section 10 includes an upper keyboard, a lower keyboard, and a pedal keyboard. The key depression detection circuit 11 operates to detect a key depressed in the keyboard section 10 and to assign data representative of the key thus depressed to the channel assignment circuit 12. The channel assignment circuit 12 is to assign tone production of a depressed key to one of a predetermined number of tone production channels.

The main tone generator section 13 operates to generate in a known manner the tones of keys depressed in the keyboard section 10. More specifically, in the main tone generator section 13, musical tones (i.e. tone colors) are formed for keys depressed in the upper keyboard, the lower keyboard and the pedal keyboard in manners which are different depending upon the kind of keyboard. The auxiliary tone generator section 14 provided in parallel with the main tone generator section 13 is an additional musical tone generating circuit which constitutes an essential part of this invention.

In this example, the auxiliary tone generator section is equally and commonly used by the upper keyboard and the lower keyboard. In other words, the auxiliary tone generator section 14 is selectively used for the upper keyboard and the lower keyboard by means of a keyboard selecting switch 15. For instance, the auxiliary tone generator section 14 produces musical tones in response to the key depression of the upper keyboard when the keyboard selecting switch 15 is opened, and it produces musical tones in response to the key depression of the lower keyboard when it is closed. The output musical tone signals of the tone generator sections 13 and 14 are applied to an acoustic system which thereupon produces musical tones.

In the electronic musical instrument thus organized, the number of channels to which the channel assignment circuit 12 can assign tone production is sixteen (16). More specifically, the number of channels exclusively used for the upper keyboard is seven (7), the number of channels exclusive for the lower keyboard is also seven (7), the number of channels exclusive for the pedal keyboard is one (1), and the number of channels exclusive for special effects such as an automatic arpeggio performance is also (1). The main tone generator section 13 has tone generators corresponding to the above-described channels.

In the channel assignment circuit 12, the tone production channels are formed by the time slots for processing signals in time division manner. The relationship in between the time slots and the channels (channel Nos. ) is as indicated in the part (a) of FIG. 2, in which reference numerals in time slots designate the respective channels. The part (b) of FIG. 2 indicates seven (7) time slots (higher pulse level indicates the allotment) for the upper keyboard exclusive channels; the part (c) of FIG. 2, seven (7) time slots for the lower keyboard exclusive channels; the part (d) of FIG. 2, one time slot for the pedal keyboard exclusive channel; and the part (e) of FIG. 2, one time slot for the special effect channel. The channel assignment circuit 12 delivers key codes KC representative of depressed keys, which are assigned to the respective channels, in time division manner, according to the channel times shown in the part (a) of FIG. 2. The key code KC consists of a 4-bit note code $N_1$, $N_2$, $N_3$, $N_4$ for identifying twelve notes C through B and a 3-bit block code $B_1$, $B_2$, $B_3$ for identifying the octave blocks of the note. In addition, the channel assignment circuit 12 outputs a first key-on signal $KO_1$ in time division manner which represents whether a key assigned to the respective channel is being depressed (the signal $KO_1$ being at "1") or it is released (the signal $KO_1$ being at "0"). Furthermore, the channel assignment circuit 12 outputs a second key-on signal $KO_2$ which is raised to "1" only during a short period of time which occurs at the beginning of key depression, and various control data (information) when required.

The key code KC and the key-on signals $KO_1$ and $KO_2$ and the control data are applied to the data multiplexing circuit 17, where they are multiplexed into three time slots of a 4-bot bit data $KC_1$, $KC_2$, $KC_3$, $KC_4$, in order to reduce the number of connections between an integrated circuit chip including the channel assignment circuit 12 and an integrated circuit chip including the tone generator sections 13 and 14. Before multiplexing and delivering the key data, the data multiplexing circuit 17 delivers a reference data for deciding the time slot of locating the key data of each channel. The reference data is the data of which all the bits $KC_1$, $KC_2$, $KC_3$, $KC_4$ are at "1".

The number of time slots for the multiplexed data $KC_1$–$KC_4$ outputted by the data multiplexing circuit 17 is forty-eight (48) in total. The contents of the data $KC_1$–$KC_4$ in the time slots "1" through "48" are as indicated in FIG. 3, with the time slot "1" being for generation of the reference data "1 1 1 1". In FIG. 3, reference characters "U", "L", "P" and "ARP" in the column "KEYBOARD" mean channels to which the notes of the upper keyboard, the lower keyboard, the pedal keyboard, and the special effects are assigned, respectively, and reference numerals in the column "CHANNEL" designate channels to which the data $N_1$–$N_4$, $B_1$–$B_3$, $KO_1$ and $KO_2$ are assigned. The time slots "1" through "48" occur repeatedly.

As is apparent from FIG. 3, three time slots are provided for the multiplexed data $KC_1$–$KC_4$ with respect to one channel. If it is assumed that one time slot is one bit time, then the channel of the data $KC_1$–$KC_4$ is switched every three bit times. In the first time slots "4", "7", "10" - - - "46" of the channels, the second key-on signal $KO_2$ is assigned to the most significant bit $KC_4$.

The block code $B_1$–$B_3$ is assigned to the $KC_1$–$KC_3$, and the first key-on signal $KO_1$ is assigned to the $KC_4$. The note code $N_1$–$N_4$ is assigned to the data $KC_1$–$KC_4$. In each channel, the block code $B_1$–$B_3$ and the first key-on signal $KO_1$ are assigned to the time slot ("2", "5", "8" - - - "47") immediately before the time slot of the note code $N_1$–$N_4$. In order words, the block code $B_1$–$B_3$ and the first key-on signal $KO_1$ appear as the data $KC_1$–$KC_4$ every three bit times. The note code $N_1$–$N_4$ is assigned to the time slots "3", "6" - - - "48", and appears as the data $KC_1$–$KC_4$.

An electronic musical instrument employing the above-described data multiplexing circuit 17 is described in detail in the specification of U.S. patent application Ser. No. 927,007 filed on July 28, 1978 assigned to the same assignee as the present case. The detailed description thereof will be omitted because it is not essential for the present invnetion.

One example of the relation between the contents of the note codes $N_1$–$N_4$ and the twelve notes C# through C is indicated in Table 1 below. The values of the note codes $N_1$–$N_4$ correspond to the tone pitches of the notes, the note C# being the lowest note, the note C being the highest note within an octave. The value of the note code representative of the note C is changed from "1 1 1 1" to "1 1 0 0". This is to prevent the note code representative of the note C from being mistaken for the reference date "1 1 1 1" (cf. the time slot "1" in FIG. 3) when it is transferred in the form of data $KC_1$–$KC_4$.

TABLE 1

| Note | $N_4$ | $N_3$ | $N_2$ | $N_1$ | Decimal number |
|---|---|---|---|---|---|
| C# | 0 | 0 | 0 | 1 | 1 |
| D | 0 | 0 | 1 | 0 | 2 |
| D# | 0 | 0 | 1 | 1 | 3 |
| E | 0 | 1 | 0 | 1 | 5 |
| F | 0 | 1 | 1 | 0 | 6 |
| F# | 0 | 1 | 1 | 1 | 7 |
| G | 1 | 0 | 0 | 1 | 9 |
| G# | 1 | 0 | 1 | 0 | 10 |
| A | 1 | 0 | 1 | 1 | 11 |
| A# | 1 | 1 | 0 | 1 | 13 |
| B | 1 | 1 | 1 | 0 | 14 |
| C | 1 | 1 | 1(0) | 1(0) | 15 |

The relations between the contents of the block codes $B_1$–$B_3$ and the octave ranges are indicated in Table 2 below:

TABLE 2

| | | | Octave Range | | |
|---|---|---|---|---|---|
| $B_3$ | $B_2$ | $B_1$ | Upper Keyboard | Lower Keyboard | Pedal Keyboard |
| 0 | 0 | 0 | C3 | C2 | C2 |
| 0 | 0 | 1 | C#3–C4 | C#2–C3 | C#2–C3 |
| 0 | 1 | 0 | C#3–C5 | C#3–C4 | C#3–C4 |
| 0 | 1 | 1 | C#5–C6 | C#4–C5 | — |
| 1 | 0 | 0 | C#6–C7 | C#5–C6 | — |

In Table 2, the relations between the contents of the block codes $B_1$–$B_3$ and the octave ranges are different according to the kind of keyboard. For instance, the key range of the upper keyboard is from note C3 to note C7, and notes (B2 and so forth) lower than the note C3 and notes (C#7 and so forth) higher than the note C7 are not included. The key range of the lower keyboard is from note C2 to note C6. Even with same block code $B_1$–$B_3$ its corresponding octave range of the upper keyboard is different by one octave from that of the lower keyboard. The octave range for the same block code $B_1$–$B_3$ is not the ordinary octave range from note C to note B, but a range from note C# to the next higher note C. Accordingly, the block code $B_1$–$B_3$ having contents "0 0 0" for the lowest range is applied only to the lowest note C.

In the main tone generator section 13, the note codes $N_1$–$N_4$, block codes $B_1$–$B_3$ and key-on signals $KO_1$ and $KO_2$ are taken out of the data $KC_1$–$KC_4$ supplied from the data multiplexing circuit with respect to each of the channels, and musical tones are produced with the aid of these key data with respect to each of the channels.

The data $KC_1$–$KC_4$ supplied by the data multiplexing circuit 17 are applied to the auxiliary tone generator section 14. In this auxiliary tone generator section 14, only the key data of keys of a single keyboard which has been selected by a keyboard selecting key 15 are taken out of the data $KC_1$–$KC_4$, and musical tones are produced with the aid of the key data of the keyboard thus taken out.

Figure 4:
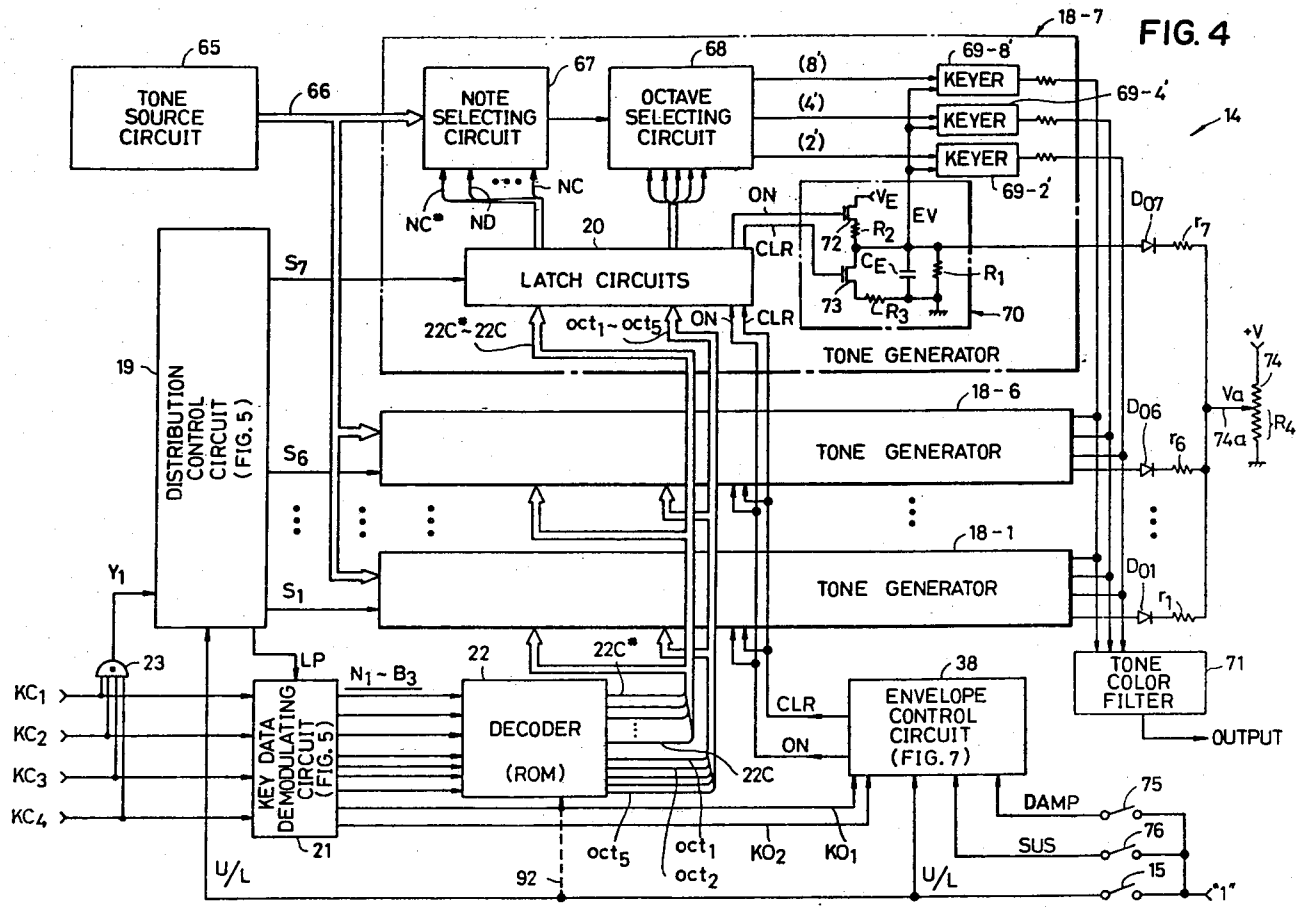
FIG. 4 is a block diagram showing one example of an auxiliary tone generator section in FIG. 1.

The auxiliary tone generator section 14, as illustrated in FIG. 4 in detail, has tone generators 18-1 through 18-7 corresponding to seven channels. The number "7" corresponds to the number of channels for the upper keyboard or the lower keyboard. That is, the auxiliary tone generator section 14 is used commonly for the upper keyboard and the lower keyboard. More specifically, when the keyboard selecting switch 15 is opened, the key data assigned to the upper keyboard exclusive channels are selected out of the multiplexed data $KC_1$–$KC_4$, and are distributed to the tone generators 18-1 through 18-7. When the keyboard selecting switch 15 is closed, the key data assigned to the lower keyboard exclusive channels are selected out of the multiplexed data $KC_1$–$KC_4$, and are distributed to the tone generators 18-1 through 18-7.

A distribution control circuit 19 operates to control the distribution of key data to the tone generators 18-1 through 18-7, and the control is effected according to the state of the keyboard selecting switch 15. In other words, as was described before, when the auxiliary tone generator 14 is used for the upper keyboard, the distribution control circuit distributes the key data assigned to the upper keyboard exclusive channels to the tone generators 18-1 through 18-7, and when the auxiliary tone generator section is used for the lower keyboard, the key data assigned to the lower keyboard exclusive channels to the tone generators 18-1 through 18-7.

This distribution control is achieved by supplying strobe signals $S_1$ through $S_7$ to latch circuits 20 provided in the tone generators 18-1 through 18-7 with suitable timing. In FIG. 4, only the tone generator 18-7 is illustrated in detail; however, it should be noted that the same latch circuits 20 are provided in the remaining tone generators 18-1 through 18-6.

A key data demodulating circuit 21 operates to demodulate the key data $N_1$–$N_4$, $B_1$–$B_3$, $KO_1$, $KO_2$ assigned to the channels from the multiplexed data $KC_1$–$KC_4$ and to output the key data in a parallel mode. The note code $N_1$–$N_4$ and the block code $B_1$–$B_3$ outputted by the key data demodulating circuit 21 are applied to a decoder 22, where they are decoded and are provided selectively to note lines 22C# through 22C and octave lines $oct_1$ through $oct_5$. The signals on the output lines 22C# through 22C and $oct_1$ through $oct_5$ are applied to data input terminals of the latch circuits 20 in the tone generators 18-1 through 18-7.

Figure 5:
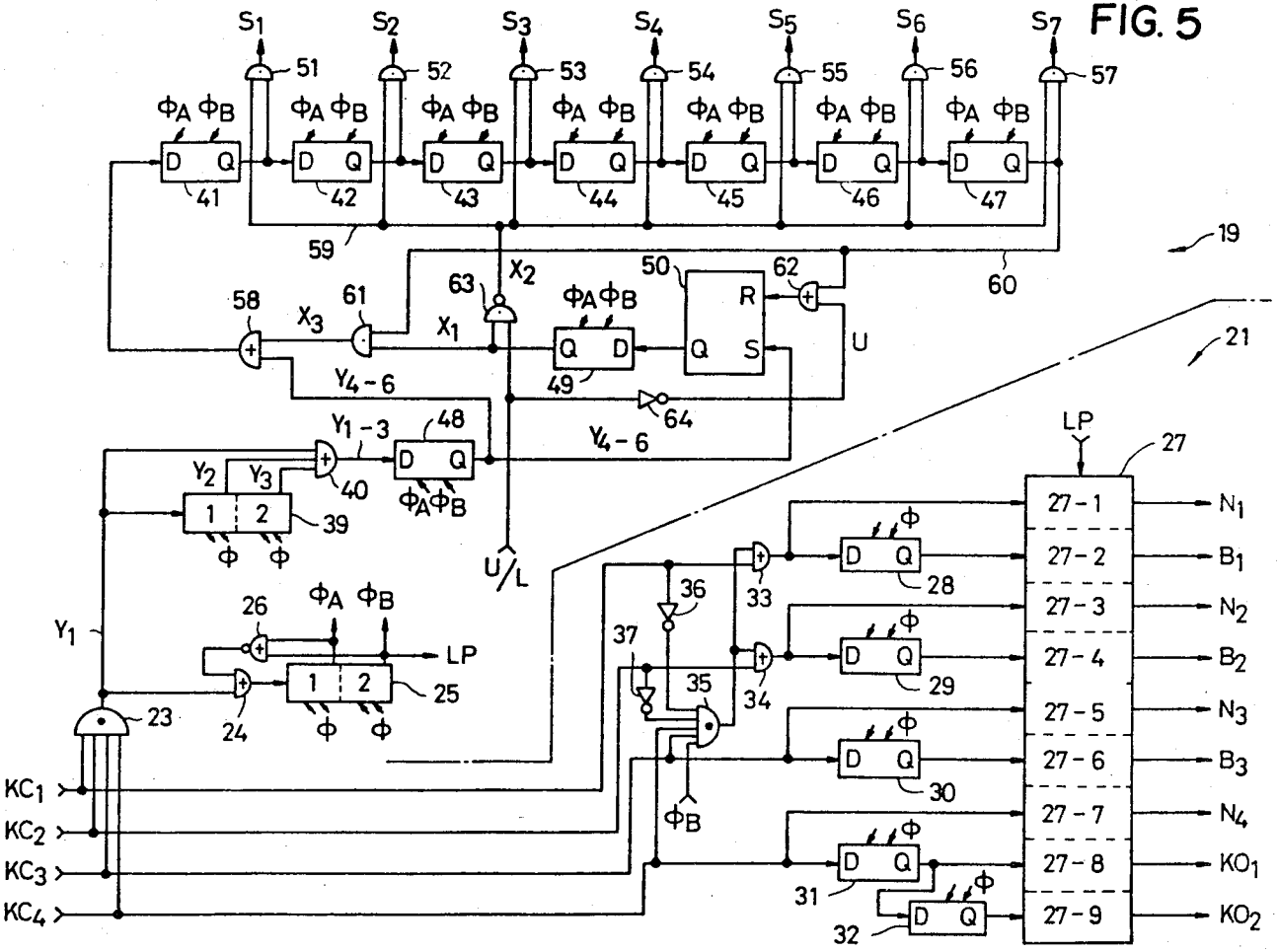
FIG. 5 is a circuit diagram showing the detail of a distribution control circuit and a key data demodulating circuit in FIG. 4.

The distribution control circuit 19 and the key data demodulating circuit 21 are illustrated in detail in FIG. 5. The key data $KC_1$–$KC_4$ from the data multiplexing circuit 17 are applied to the key data demodulating circuit 21 and to an AND circuit 23 which detects the reference data "1 1 1 1". As is apparent from FIG. 3, the reference data "1 1 1 1" is delivered out in the time slot "1" of the multiplexed data $KC_1$–$KC_4$. Accordingly, when the output of the AND circuit 23 is raised to "1", the time slot "1" occurs. The output "1" of the AND circuit 23 is applied, as a reference pulse signal $Y_1$ (FIG. 6, (b)), to the distribution control circuit 19.

In the distribution control circuit 19, in response to the application of the reference pulse signal $Y_1$ the time slots "2" through "48" occurring after that are judged, and the strobe signals $S_1$ through $S_7$ and a latch pulse LP are provided in the time slots in which desired data are provided.

The generation of the latch pulse LP will be described. Referring to FIG. 5, the reference pulse signal $Y_1$ is applied through an OR circuit 24 to a two-stage shift register 25. This shift register 25 is driven by a main clock pulse $\phi$ (or two-phase clock pulses) synchronous with the time division time slot (for instance 1 $\mu$s; cf. FIG. 6(a)) of the data $KC_1$–$KC_4$, and the outputs of the two stages of the shift register 25 are fed back to the input side thereof through a NOR circuit 26 and the OR circuit 24. When the outputs of the two stage of the shift register 25 are set to "0", the output of the NOR circuit 26 is raised to "1", as a result of which the signal "1" is inputted into the first stage of the shift register 25. The output of the first stage and the output of the second stage of the shift register 25 are utilized respectively as a pulse $\phi_A$ (FIG. 6, (c)) and a pulse $\phi_B$ (FIG. 6, (d)) for other shift registers. The phase of the pulse $\phi_A$ is shifted by one bit time from that of the pulse $\phi_B$ as is clear from FIG. 6. Each of the pulses $\phi_A$ and $\phi_B$ has a pulse width of one bit time and a period of three bit times. This pulse $\phi_B$ is applied, as the latch pulse LP, to a latch circuit 27 in the key data demodulating circuit 21. As is clear from the part (d) of FIG. 6, the latch pulse LP is generated two bit times after the provision of the reference pulse signal $Y_1$ (in the time slot "3"), and thereafter it is provided every three bit times (in the time slots "6", "9", "12" and so forth).

The latch circuit 27 of the key data demodulating circuit 21 has nine latch positions 27-1 through 27-9. The nine latch positions 27-1 through 27-9 correspond to the note code $N_1$–$N_4$, block code $B_1$–$B_3$ and key-on signal $KO_1$, $KO_2$, respectively. The data $N_1$–$B_3$, $KO_1$, $KO_2$ for one channel supplied in three bit times are simultaneously lached by the latch circuit 27 with the timing of generation of the latch pulse LP. As is clear from FIGS. 3 and 6, the latch pulse LP is provided in synchronization with the time slots in which the note codes $N_1$–$N_4$ are supplied as the data $KC_1$–$KC_4$. Accordingly, the bits of the data $KC_1$–$KC_4$ are inputted directly into the latch positions 27-1, 27-3, 27-5 and 27-7 corresponding to the bits of the note code $N_1$–$N_4$. In one and the same channel, the block code $B_1$–$B_3$ and first key-on signal $KO_1$ are supplied in the form of data $KC_1$–$KC_4$ in the time slot one bit time before the time slot of the note code $N_1$–$N_4$. Therefore, the bits of this data $KC_1$–$KC_4$, after being delayed by delay flip-flops 28, 29, 30 and 31, are applied to the latch positions 27-2, 27-4, 27-6 and 27-8 corresponding to the block code $B_1$–$B_3$ and first key-on signal $KO_1$. In one and the same channel, the second key-on signal $KO_2$ is supplied in the form of data $KC_4$ in the time slot one bit time before the time slot of the first key-on signal $KO_1$. Therefore, after being delayed by the delay flip-flop 31, the data $KC_4$ is further delayed by one bit by a delay flip-flop 32, and thereafter is applied to the latch position 27-9 corresponding to the second key-on signal $KO_2$.

Thus, when the latch pulse LP is provided, the note code $N_1$–$N_4$, block code $B_1$–$B_3$ and key-on signals $KO_1$ and $KO_2$ of the channel are supplied simultaneously to the input side of the latch circuit 27, and therefore these key data $N_1$–$N_4$, $B_1$–$B_3$, $KO_1$, and $KO_2$ are latched at the same time. The contents of the latch circuit 27 is rewritten every three bit times in response to the latch pulse LP, and the channel of the data $KC_1$–$KC_4$ is changed every three bit times (cf. FIG. 3). Therefore, the contents of the latch circuit 27 is rewritten into the key data $N_1$–$N_4$, $B_1$–$B_3$, $KO_1$, $KO_2$ of different channels successively every three bit times.

Figure 6:
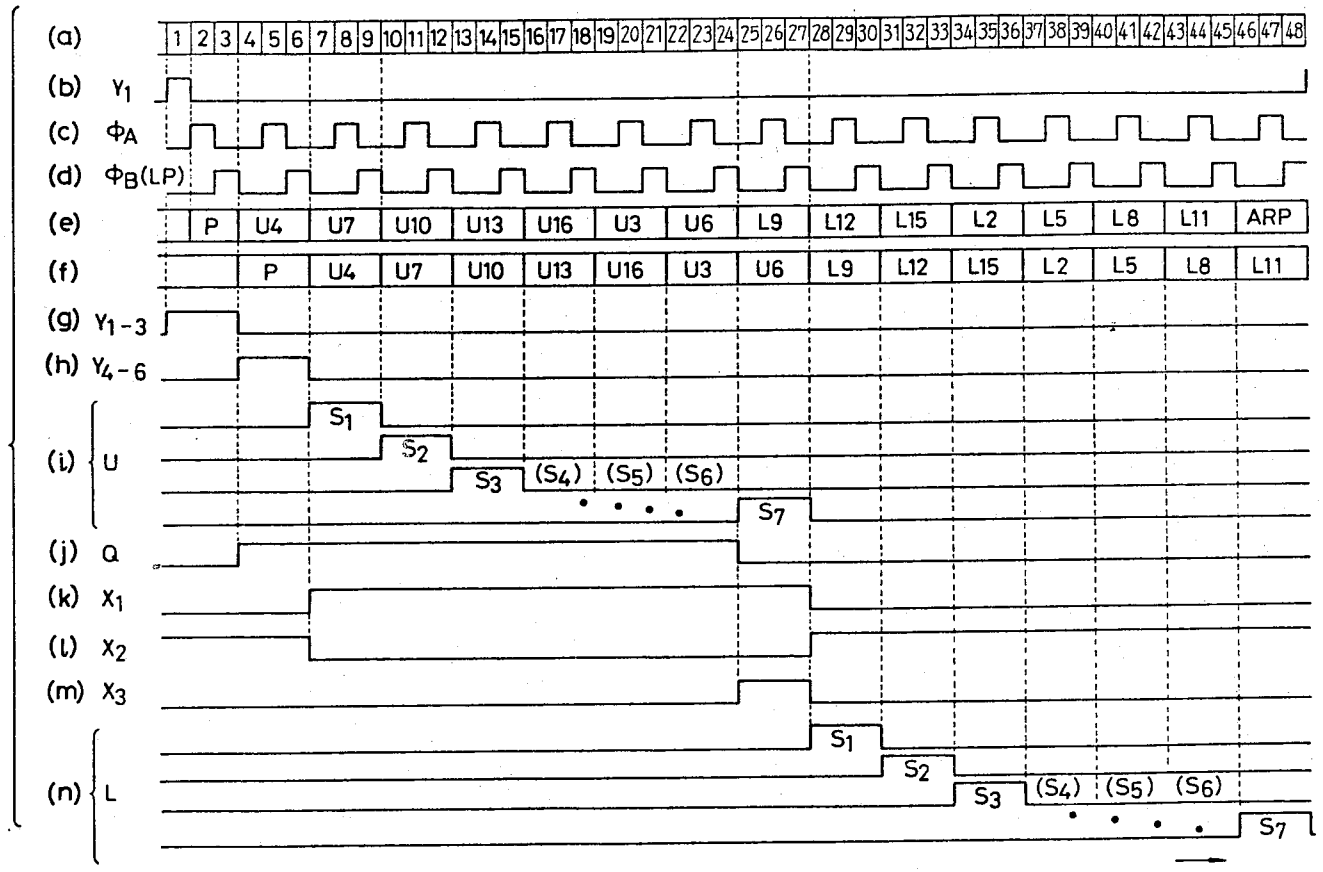
FIG. 6 is a timing chart for describing the operation of the circuitry shown in FIG. 5.

The simplified states of the data $KC_1$–$KC_4$ in the time slots "1" through "48" indicated in FIG. 3 are shown in the part (e) of FIG. 6. In the part (e) of FIG. 6, reference character "p" designates the pedal keyboard channel; "U" of reference characters "U4" through "U6" designates the upper keyboard exclusive channel, the suffix number designating the channel name; and "L" of reference characters "L9" through "L11" designates the lower keyboard exclusive channel, the suffix number designating the channel name. The part (f) of FIG. 6 indicates the channels to which the key data $N_1$–$KO_2$ outputted by the latch circuit 27 in the time slots have been assigned. For instance, the key data $N_1$–$N_4$, $B_1$–$B_3$, $KO_1$ of a key depressed in the pedal keyboard is inputted into the latch circuit 27 with the aid of the latch pulse LP produced in the time slot "3", and it is continuously outputted by the latch circuit 27 for the period of time of from the time slot "4" to the time slot "6". The key data $N_1$–$N_4$, $B_1$–$B_3$, $KO_1$, $KO_2$ of a key depressed in the upper keyboard, which has been assigned to the fourth channel of the upper keyboard (U4), is inputted to the latch circuit 27 with the aid of the latch pulse LP produced in the next time slot "6" and it is continuously outputted by the latch circuit 27 for the period of time from the time slot "7" to the time slot "9". Thereafter, as indicated in the part (f) of FIG. 6, the channels of the key data $N_1$–$B_3$, $KO_1$, $KO_2$ outputted by the latch circuit 27 are changed.

In the key data demodulating circuit 21, a circuit comprising OR circuits 33 and 34, an AND circuit 35 and inverters 36 and 37 is provided at the front stage of the delay flip-flops 28 through 32. This circuit is to change the note code $N_1$–$N_4$ of the note C to its original value "1 1 1 1". As was described before, the note code $N_4$–$N_1$ of the note C from the data multiplexing circuit 17 is changed to the value "1 1 0 0" so that it may not be mistaken for the reference data "1 1 1 1". Signals obtained by inverting the less significant data $KC_1$ and $KC_2$ with the inverters 36 and 37 and the more significant data $KC_3$ and $KC_4$ are applied to the five-input AND circuit 35, whereby the AND circuit 35 detects the arrivel of the change code "1 1 0 0" of the note C. The pulse $\phi_B$ which is equal to the latch pulse LP is applied to the remaining input terminal of the AND circuit 35, and accordingly the above-described detection can be effected only in the time slot in which the note code $N_1$–$N_4$ is supplied. Upon detection of the change code "1 1 0 0" of the note C, the output of the AND circuit 35 is raised to "1", and this output "1" is applied through the OR circuits 33 and 34 to the latch positions 27-1 and 27-3 of the latch circuit 27, respectively.

The note codes $N_1$–$N_4$ and block codes $B_1$–$B_3$ of the channels outputted by the latch circuit 27 in time division manner with the timing as indicated in the part (f) of FIG. 6 are applied to the decoder 22 (FIG. 4) as described before, and the first and second key-on signals $KO_1$ and $KO_2$ are applied to an envelope control circuit 38 (FIG. 4). The envelope control circuit 38 produces a charge signal ON and a clear signal CLR for controlling the amplitude envelope of a musical tone by the utilization of the key-on signals $KO_1$ and $KO_2$ as described later. The relations between the generation time slots and the channels of the charge signal ON or the clear signal CLR outputted by the envelope control circuit 38, note select signals on the output lines 22C# through 22C and octave select signals on the output lines $oct_1$ through $oct_5$ of the decoder 22 are similar to those in the part (f) of FIG. 6. The charge signal ON and the clear signal CLR, similarly as in the signals on the output lines 22C# through 22C and $oct_1$ through $oct_5$, are applied to the latch circuits 20 of the tone generators 18-1 through 18-7.

As is apparent from the above description, the signals (ON, CLR, and the signals on the lines 22C#–22C, and $oct_1$–$oct_5$) of the channels applied to the data input terminals of latch circuits 20 of the tone generators 18-1 through 18-7 have been subjected to time division multiplexing, as shown in the part (f) of FIG. 6. In order to distribute only those concerning a keyboard selected by the keyboard selecting switch 15 among the signals thus treated to the tone generators 18-1 through 18-7, strobe signals $S_1$ through $S_7$ are produced by the distribution control circuit 19.

In the distribution control circuit 19, the reference pulse signal $Y_1$ is applied to a 2-stage shift register 39 and to one of the three input terminals of an OR circuit 40. The outputs of the two stages of the shift register 39 are applied to the remaining two input terminals of the OR circuit 40. The shift register 39 is driven by the main clock pulse $\phi$. If the reference pulse signal $Y_1$ is produced in the time slot "1", in the time slot "2" occurring one bit time later the output $Y_2$ of the first stage of the shift register 39 is raised to "1", and in the time slot "3"

occurring one bit time later the output $Y_3$ of the second stage of the shift register 39 is raised to "1". The output $Y_{1-3}$ of the OR circuit 40, receiving these signals $Y_1$, $Y_2$ and $Y_3$, is maintained at "1" for three bit times, that is, from the time slot "1" to the time slot "3".

This output signal $Y_{1-3}$ of the OR circuit 40 is delayed by three bit times by a delay flip-flop 48. This delay flip-flop 48 and other flip-flops 49 and 41 through 47 are driven by two-phase pulses $\phi_A$ and $\phi_B$ having a period of three bit times (FIG. 6, (c) and (d)). The output signal $Y_{4-6}$ of the delay flip-flop 48 (FIG. 6,(h)) is applied to the set input terminal (s) of a set-reset type flip-flop 50, and it is applied to the delay flip-flop 41 through an OR circuit 58.

The delay flip-flops 41 through 47 are cascade-connected to form a delay flip-flop group. In this delay flip-flop group, the signal "1" having a time width of three bit times supplied by the OR circuit 58 is successively shifted, thereby to form the timing to provide the strobe signals $S_1$ through $S_7$. The outputs of the delay flip-flops 41 through 47 are applied to one input terminals of AND circuits 51 through 57 for producing the strobe signals $S_1$ through $S_7$, respectively. A signal on a line 59 is applied to the other input terminals of the AND circuit 51 through 57. The output of the last delay flip-flop 47 is applied through a line 60 to an AND circuit 61 and it is applied through an OR circuit 62 to the reset input terminal (R) of the flip flop 50. In the case where the upper keyboard is selected by the keyboard selecting switch 15, the signal "1" having a time width of three bit times is shift in the delay flip-flop train 41 through 47 only once; and in the case where the lower keyboard is selected, the signal "1" is circulated in the flip-flop train twice.

First, the case where the upper keyboard is selected will be described. In this case, a keyboard selection signal U/L supplied by the keyboard selecting switch 15 is at "0", and the output $X_2$ of a NAND circuit 63 is at "1" at all times. This output $X_2$ of the NAND circuit 63 is applied to the AND circuits 51 through 57 through the line 59, thereby to enable the latter 51 through 57 at all times. The keyboard selection signal U/L is inverted to "1" by an inverter 64. This output "1" of the inverter 64 is applied through the OR circuit 62 to the reset input terminal (R) of the flip-flop 50. Accordingly, the flip-flop 50 is maintained reset. Accordingly, the signal $X_1$ being applied from the set output (Q) side of the flip-flop 50 to the AND circuit 61 is "0". Thus, the output of the OR circuit 58 is raised to "1" only when the signal $Y_{4-6}$ of the delay flip-flop 48 is applied to the one input terminal of the OR circuit 58. This signal $Y_{4-6}$ is successively delayed by the delay flip-flops 41 through 47 every three bit times. Therefore, the outputs of the AND circuits 51 through 57 are successively raised to "1" in response to the provision of delay outputs "1" of the delay flip-flops 41 through 47. The outputs "1" of the AND circuits 51 through 57 are supplied, as the strobe signals $S_1$ through $S_7$, to the latch circuits 20 in the tone generators 18-1 through 18-7, respectively. The generation of the strobe signals $S_1$ through $S_7$ in the case of selection of the upper keyboard is as indicated in the part (i) of FIG. 6.

As is clear from FIG. 6, for three bit times from the time slot "7" to the time slot "9" after the provision of the signal $Y_{4-6}$ the output of the delay flip-flop 41 is raised to "1", as a result of which the AND circuit 51 outputs the strobe signal $S_1$. This strobe signal $S_1$ is supplied to the latch circuit (not shown, but corresponding to the latch circuit 20 in the tone generator 18-7) in the tone generator 18-1 (FIG. 4) thereby to allow the latch circuit (20) to latch the signals on the lines 22C#–22C and $oct_1$–$oct_5$ and the signals ON and CLEAR. It will become apparent from the parts (f) and (i) on FIG. 6 that, when the strobe signal $S_1$ is produced, the key data assigned to the fourth channel (U4) of the upper keyboard is outputted by the latch circuit 27 or the envelope control circuit 38 or the decoder 22. Accordingly, the key data assigned to the fourth channel (U4) of the upper keyboard is distributed to the tone generator 18-1.

Thereafter, the signal "1" having a time width of three bit times is successively shifted from the delay flip-flop 42 to the delay flip-flop 47, as a result of which the strobe signals $S_2$, $S_3$, $S_4$, $S_5$, $S_6$ and $S_7$ are successively produced. As shown in the part (f) of FIG. 6, the key data of the channels U7, U10, U13, U16, U3 and U6 are supplied to the respective tone generators 18-2 through 18-7 in synchronization with the timing of generation of the strobe signals $S_2$ through $S_7$. In consequence, the key data assigned to seven channels U4, U7, U10, U13, U16, U3 and U6 exclusive for the upper keyboard are distributed to the seven tone generators 18-1 through 18-7, respectively.

The case where the lower keyboard is selected by the keyboard selecting switch 15 will be described. In this case, the keyboard selection signal U/L is at "1", and therefore one of the inputs to the NAND circuit 63 is maintained at "1" at all times. The operation of the NAND circuit 63 depends therefore on the output signal $X_1$ of the delay flip-flop 49 which is applied to the other input terminal of the NAND circuit 63. As the keyboard selection signal U/L is at "1", the output of the inverter 64 is at "0", and accordingly the flip-flop 50 is reset depending on the signal on the line 60. Normally, the signal on the line 60 is at "0", and therefore the flip-flop 50 is not reset. Therefore immediately when the output signal $Y_{4-6}$ (FIG. 6,(h)) of the delay flip-flop 48 is raised to "1", the flip-flop 50 is set, and its set output (Q) rises in the time slot "4" as shown in the part (j) of FIG. 6.

The set output (Q) of the flip flop 50 is delayed by three bit times by the delay flip-flop 49, and therefore the output signal $X_1$ of the delay flip-flop 49 is produced as indicated in the part (k) of FIG. 6. The output signal $X_1$ of the delay flip-flop 49 is inverted by the NAND circuit 63, and therefore the signal $X_2$ on the output line 59 of the NAND circuit 63 falls in the time slot "7" as shown in the part (l) of FIG. 6.

The output signal $Y_{4-6}$ of the delay flip-flop 48 is applied through the OR circuit 58 to the delay flip-flop 41, and it is shifted successively in the train of delay flip-flops 41 through 47. In the time slots "7" to "9", when the first delay flip-flop 41 outputs the delay signal "1", the signal $X_2$ on the line 59 has been set to "0" already. Therefore, the condition of the AND circuit 51 is not satisfied, and the strobe signal $S_1$ is not produced. Similarly, in the time slots "7" to "27", the signal "1" having a time width of three bit times is successively shifted in the delay flip-flops 41 through 47; however, as the signal $X_2$ on the line 59 is at "0", the AND circuits 51 through 57 are not operated, and therefore the strobe signals $S_1$ through $S_{37}$ are not produced. During the period of time of from the time slot "7" to the time slot "27", the key data of the upper keyboard exclusive channels U4, U7, - - - U6 have been supplied to the tone generators 18-1 through 18-7, and therefore the key data on the upper keyboard are not distributed to the tone generators 18-1 through 18-7.

When the signal "1" is outputted by the last delay flip-flop 47 in the time slots "25" to "27", it is applied through the line 60 and the OR circuit 62 to the flip flop 50 to reset the latter 50 (FIG. 6,(j)). In the time slot "28" occuring one bit time later, the output signal $X_1$ of the delay flip-flop 49 falls to "0" (FIG. 6, (k)). However, as the signal $X_1$ is still at "1" for the period of time of from the time slot "25" to "27" in which the signal "1" is provided to the line 60, the condition of the AND circuit 61 is satisfied, and therefore its output signal $X_3$ is raised to "1" as shown in the part (m) of FIG. 6. The output signal $X_3$ of the AND circuit 61 is applied through the OR circuit 58 to the delay flip-flop 41.

In consequence, in the case where the lower keyboard is selected, the output of the last delay flip-flop 47 is fed back to the first delay flip-flop 41 through the line 60, the AND circuit 61 and the OR circuit 58, as a result of which the signal "1" having a time width of three bit times is shifted in the train of delay flip-flops 41 through 47 again. In the times slots "28" through "48" in which the second shifting operation is carried out, the output signal $X_1$ of the delay flip flop 49 is set to "0", and therefore the NAND circuit 63 is operated, and the signal $X_2$ on the output line 59 thereof is raised to "1". Accordingly, the AND circuits 51 through 57 are enabled, and the strobe signals $S_1$ through $S_7$ are successively produced in response to the second shifting operation as shown in the part (n) of FIG. 6. As is clear from the part (f) of FIG. 6, during the period of time of from the time slot "28" to the time slot "48", the key data assigned to the lower keyboard exclusive channels L9, L12, - - - L11 have been supplied to the latch circuits 20 in the tone generators 18-1 through 18-7, respectively, and accordingly the key data assigned to the seven lower keyboard exclusive channels L9, L12, L15, L2, L5, L8 and L11 are distributed to the seven tone generators 18-1, 18-2, 18-3, 18-4, 18-5, 18-6 and 18-7, respectively.

Now, the tone generators 18-1 through 18-7 will be described. The arrangement of only the tone generator 18-7 is illustrated in detail in FIG. 4; however, it should be noted that the remaining tone generators 18-1 through 18-6 is similar in construction to the tone generator 18-7. A tone source circuit 65 operates to produce square wave tone source signals different in tone pitch according to frequency division system. The tone source signals are supplied through a tone source signal bus 66 to the tone generators 18-1 through 18-7. The signal on the tone source bus 66 is applied to a note selecting circuit 67, in which according to the note select signals NC#–NC which are continuously supplied thereto from the latch circuit 20 a tone source signal corresponding to the note of the key data assigned to the relevant channel is selected. The note select signals NC#–NC are obtained by latching with the latch circuit 20 the signals on the decode output lines 22C#–22C which have been provided by decoding the note code $N_1$–$N_4$ by the decoder 22. The tone source signals of the single note selected by the note selecting circuit 67 are of a plurality of octave ranges. An octave selecting circuit 68 operates to select the tone source signal of necessary octave range out of the tone source signals selected by the note selecting circuit 67. The signals on the decode output lines $oct_1$–$oct_5$ which have been obtained by decoding the block code $B_1$–$B_3$ by the decoder 22 are latched by the latch circuit 20 to be used as selection control signals of the octave selecting circuit 68. In the octave selecting circuit 68, the tone source signals for the 8-foot register (8'), the 4-foot register (4') and the 2-foot register (2') are selected and outputted. The tone source signals for these footage registers are applied to tone keyers 69-8', 69-4' and 69-2', respectively, and are subjected to keying control in accordance with an envelope waveform voltage signal EV supplied to the tone keyers from an envelope waveform generating section 70. The tone source signals thus subjected to keying control are supplied to a tone color filter 71, where they are tone-colored individually and are then supplied to the acoustic system 16. It is not always necessary to provide the frequency division type tone source circuit 65 only for the auxiliary tone genertor section 14; that is, the tone source circuit used in the main tone generator section 13 may be used commonly for the auxiliary tone generator section 14. Furthermore, instead of the frequency division type circuit, a multiplexed octavely-related frequency data generating circuit as described in the specification of U.S. patent application Ser. No. 915,239, assigned to the same assignee as the present case, may be employed as the tone source circuit 65. In this case, an individual frequency data generating section disclosed by that specification should be used as the octave selecting circuit 68.

The envelope control will be described. The envelope waveform generating section 70 comprises a capacitor $C_E$ and a discharging resistor $R_1$ which are externally connected to the integrated circuit chip. The charge and discharge waveform of the capacitor $C_E$ is supplied, as the envelope waveform voltage signal EV, to the switching gates 69-8', 69-4' and 69-2'. A field-effect transistor 72 connected between the supply voltage $V_E$ and the capacitor $C_E$ is controlled by the continuous charge signal ON supplied to its gate electrode from the latch circuit 20, whereby the capacitor $C_E$ is charged when the transistor 72 is rendered conductive. A field-effect transistor 73 connected in parallel to the capacitor $C_E$ is controlled by the continuous clear signal CLR applied to its gate electrode from the latch circuit 20, whereby the capacitor $C_E$ is quickly discharged when the transistor 73 is rendered conductive. The resistances of resistors $R_2$ and $R_3$ are much lower than that of the resistor $R_1$.

In order to adjust the sustain length of the envelope waveform voltage signal EV produced by the envelope waveform generating section 70, a sustain length adjuster 74 is provided. This sustain length adjuster 74 is used commonly for the envelope waveform generating sections 70 in the tone generators 18-1 through 18-7. For this purpose, the sustain length adjuster 74 is connected through diodes $D_{01}$–$D_{07}$ and low resistors $r_1$–$r_7$ to the capacitors $C_E$ and the resistors $R_1$, and the lead wires extended from the tone generators 18-1 through 18-7 are commonly connected to the operating piece **74*a* of the adjuster 74**.

The charge signals ON and the clear signals CLR are produced by the envelope control circuit 38 (as illustrated in detail in FIG. 7) in time division manner separately according to the channels (as indicated in the part (f) of FIG. 6). These signals are latched by the latch circuit 20 as described before, and are supplied to the transistors 72 and 73. The envelope control circuit 38 is provided with an envelope waveform controlling damper switch 75 and a waveform selecting switch 76 (FIG. 4). The damper switch 75 is operated to quickly finish the envelope. When the damper switch 75 is turned on, a damper signal DAMP is raised to "1". This output damper signal DAMP of the damper switch 75 is applied through an OR circuit 77 to an AND circuit 78 in FIG. 7.

The waveform selecting switch 76 is to select one of a sustain system envelope waveform and a percussion system envelope waveform. When the switch 76 is turned on, a sustain selection signal SUS is raised to "1", as a result of which the sustain system envelope waveform is selected. The sustain selection signal SUS outputted by the switch 76 is applied to an AND circuit 79 and an inverter 80. When the switch 76 is turned off, the sustain selection signal SUS is at "0". As this signal SUS at "0" is applied to the inverter 80, the output, or a percussion selection signal PER, of the inverter 80 is raised to "1", as a result of which the percussion system envelope waveform is selected. The percussion selection signal PER is applied to an AND circuit 81.

Figure 7:
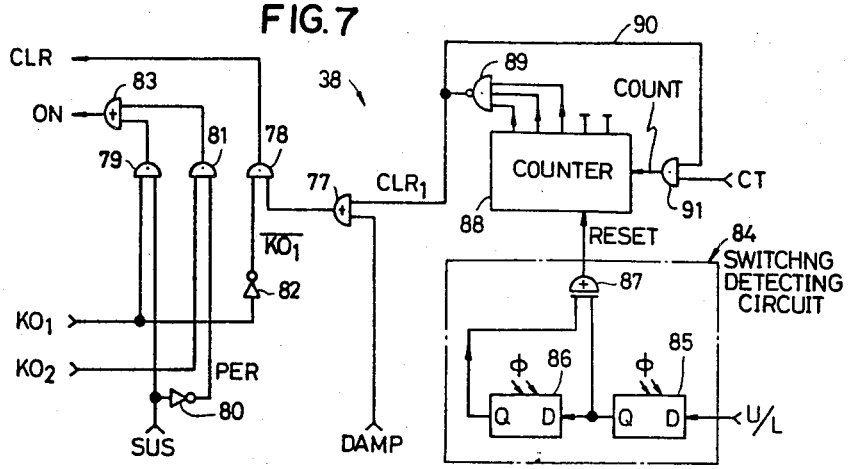
FIG. 7 is a circuit diagram showing details of an envelope control circuit in FIG. 4.

The first key-on signal $KO_1$ outputted by the latch circuit 27 in the key data demodulating circuit 21 is applied to an AND circuit 79 (FIG. 7) and to an inverter 82, where it is inverted into a signal $\overline{KO_1}$ which is applied to the AND circuit 78. The second key-on signal $KO_2$ outputted by the latch circuit 27 is applied to the AND circuit 81 (FIG. 7). The outputs of the AND circuits 79 and 81 are applied to an OR circuit 83, and the output of the OR circuit 83 is outputted, as the charge signal ON, by the envelope control circuit 38. The output of the AND circuit 78 is outputted, as the clear signal CLR, by the envelope control circuit 38.

Now, selection of the envelope waveforms by the operation of the switch 76 will be described. The first key-on signal $KO_1$ concerning one key is maintained produced for the period of time of from the key depression to the key release as shown in the part (a) of FIG. 8. The second key-on signal $KO_2$ is produced for a short time immediately after the key depression as shown in the part (b) of FIG. 8. When the sustain selection signal SUS is maintained at "1" by turning on the switch 76, the charge signal ON is produced by the AND circuit 79 in response to the first key-on signal $KO_1$ (FIG. 8, (c)). While this charge signal ON is maintained at "1", the field-effect transistor 72 (FIG. 4) is maintained conductive (ON) whereby the capacitor $C_E$ is charged. As a result, the envelope waveform voltage signal EV obtained from the capacitor $C_E$ is maintained at a certain level while the key depression is continued as shown in the part (d) of FIG. 8. Upon key release, the first key-on signal $KO_1$ is lowered to "0", whereupon the charge signal ON is eliminated, and therefore the field-effect transistor 72 is rendered non-conductive. Before the damper switch 75 is operated, the other transistor 73 is in non-conductive state, and therefore the capacitor $C_E$ is discharged through the high resistor $R_1$ and the sustain length adjuster 74. Thus, the sustain type envelope waveform voltage signal EV as shown in the part (d) of FIG. 8 can be obtained.

Figure 8:
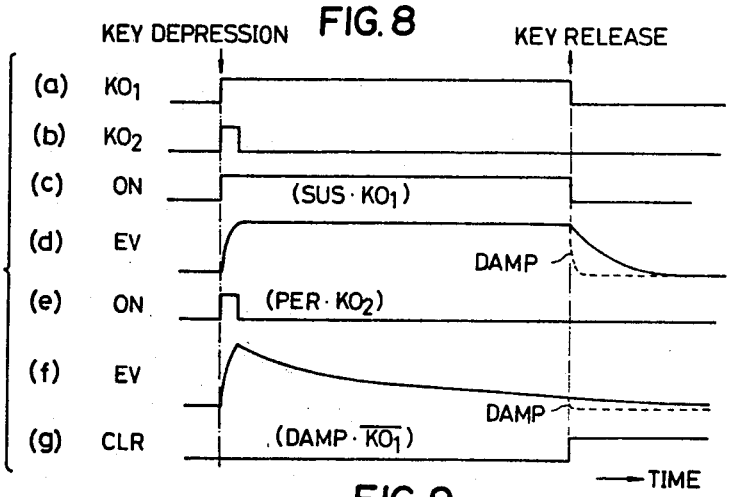
FIG. 8 is a timing chart for describing the envelope control operation of an envelope waveform generating circuit and the envelope control circuit in FIGS. 4 and 7.

When the percussion selection signal PER is maintained at "1" by turning off the switch 76, the charge signal ON is produced by the AND circuit 81 in response to the second key-on signal $KO_2$(FIG. 8 (e)). The capacitor $C_E$ is charged by this short charge signal ON. Upon elimination of the second key-on signal $KO_2$, similarly as in the above-described case, the capacitor $C_E$ is discharged through the resistor $R_1$ and the sustain length adjuster 74. As a result, the percussion type envelope waveform voltage signal EV as shown in the part (f) of FIG. 8 can be obtained.

In the case where the damper switch 75 has been operated, the AND circuit 78 outputs the clear signal CLR (FIG. 8, (g)) when the inversion signal $\overline{KO_1}$ of the first key-on signal $KO_1$ is raised to "1". As the transistor 73 (FIG. 4) is rendered conducted by this clear signal CLR "1", the capacitor $C_E$ is quickly discharged through the low resistance $R_3$. Accordingly, when the damper switch 75 is operated, the envelope waveform is quickly damped in response to the key release as indicated by the broken line DAMP in the part (d) or (f) of FIG. 8.

The sustain length control by the use of the sustain length adjuster 74 will be described.

Figure 9:
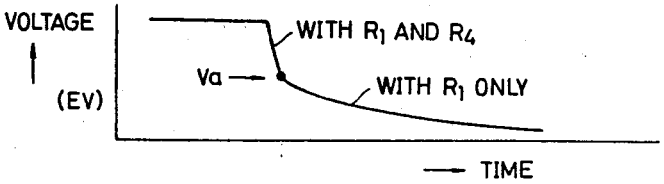
FIG. 9 is a graphical representation for describing the control of a sustain length (the time length of a decay waveform) of a sustain length adjuster.

When both of the field-effect transistors 72 and 73 are in non-conductive state, initially the capacitor $C_E$ is discharged through a parallel circuit of the resistance $R_1$ and a resistance $R_4$ which is a resistance portion on the ground side of a resistance element divided by a movable contact 74*a* of the sustain length adjuster 74. As the resistance $R_1$ is higher than the resistance $R_4$, the resistance of the parallel circuit is relatively low. Accordingly, in the case where the capacitor $C_E$ is discharged this parallel circuit, the time constant is relatively small, and therefore the discharge waveform is steeper than that in the case of only one high resistance $R_1$. When, in the course of discharge through the parallel circuit of the resistances $R_1$ and $R_4$, the envelope waveform voltage EV becomes lower than a value corresponding to a division voltage Va obtained by operating the movable contact 74*a* of the sustain length adjuster 74, the diode $D_{07}$ is reversely biased, and thereafter the capacitor is discharged only through the high resistance $R_1$. This will be described with reference to FIG. 9. The capacitor is discharged through the resistances $R_1$ and $R_4$ until the envelope waveform voltage EV (the voltage of the capacitor $C_E$) reaches the value corresponding to the division voltage Va, and therefore the waveform is relatively abruptly damped; however, when the envelope waveform valtage becomes lower than the value corresponding to the division voltage Va, the capacitor is discharge through the resistor $R_1$ only, and therefore the waveform is damped gradually.

The length of sustain is the length of time of the damped waveform. As is clear from the above description, if the value of the division voltage Va of the adjuster 74 is increased, the amount of charges discharged gradually through the large resistance $R_1$ only is increased, and accordingly the length of time (or the discharge time) of the damped waveform is also increased. In contrast, if the value of the division voltage Va is decreased, a large amount of charges is abruptly discharged through the parallel circuit of the resistances $R_1$ and $R_4$, and therefore the length of time of the damped waveform is decreased. For instance, in FIG. 4, the closer to the voltage source terminal +V is the set position of the movable contact 74*a* of the sustain length adjuster, the higher is the division voltage Va and the longer the sustain (the length of time of the damped waveform); in contrast, the closer to the ground terminal is the set position of the movable contact 74*a*, the lower is the division voltage Va and the shorter the sustain. The term "sustain" as used herein has a meaning different from "the envelope waveform of the sustain type" selected by the waveform selecting switch 76. In either the envelope waveform of the sustain type (FIG. 8,(d)) or the envelope waveform of the percussion type (FIG. 8,(f), the length of sustain thereof is adjusted by the sustain length adjuster 74.

Even in the case where the operating piece 74*a* is set to the ground potential to minimize the division voltage Va as the forward voltage drop $V_0$ of the diode $D_{07}$ (or $D_{01}$–$D_{06}$) exists, the diode $D_{07}$ is rendered non-conductive when the voltage of the envelope waveform voltage signal EV reaches the value $V_0$. Accordingly, the remaining charges corresponding to this voltage $V_0$ are gradually discharged through the high resistance $R_1$, as a result of which the waveform is slightly damped. Thus, it is impossible to quickly and completely discharge the capacitor $C_E$ merely by adding the sustain length adjuster 74 to the time constant circuit consisting of the capacitor $C_E$ and the resistor $R_1$; that is, it is difficult to obtain an envelope waveform with no sustain. However, in this example, this difficulty is overcome by connecting the field-effect transistor 73 in parallel to the capacitor $C_E$. That is, in the case where it is intended to obtain an envelope waveform having no sustain (not gradually decayed after the key release), by operating the damper switch 75 the transistor 73 is rendered conductive thereby to instantaneouly discharge the capacitor $C_E$ at the time of key release. Thus, the above-described difficulty can be eliminated.

Now, the envelope clear control effected when the keyboard selecting switch 15 is switched will be described.

In the case where the keyboard selecting switch 15 is switched immediately after a key in a keyboard using the auxiliary tone generator section 14 is released, the damped envelope waveform (or the voltage waveform of the capacitor $C_E$) concerning the keyboard still remains after the key release (assuming that the damper switch 75 is not operated yet), and therefore the produced tone is not of the keyboard which has been selected by the keyboard selecting switch 15. Assume, for instance, that the keyboard selecting switch 15 is off and the note $C_3$ of the upper keyboard is being produced by the auxiliary tone generator section. If in this state the key $C_3$ is released and the switch 15 is turned on, the damped tone of the note $C_3$ of the upper keyboard is momentarily produced although the keyboard has been switched from the upper keyboard to the lower keyboard. In order to eliminate this difficulty, the following operations are effected in the envelope control circuit 38 (FIG. 7). That is, the fact that the switch 15 has been switched is detected by a switching detecting circuit, and a clear pulse $CLR_1$ having a certain time width is supplied to the OR circuit 77 in response to this detection thereby to provide the clear signal CLR.

The keyboard selection signal U/L is supplied to the switching detecting circuit 84 from the keyboard selecting switch 15. This signal U/L is delayed successively by delay flip-flops 85 and 86. The outputs of the delay flip-flops 85 and 86 are applied to an EXCLUSIVE OR circuit 87. When the upper keyboard is switched to the lower keyboard, the signal U/L is raised to "1" from "0". In this case, when the signal U/L which is "1" is inputted into the first delay flip-flop 85, the preceding signal at "0" has been inputted into the next delay flip-flop 86. Thus, two input signals "1" and "0" are applied to the EXCLUSIVE OR circuit 87, and therefore the output of the EXCLUSIVE OR circuit 87 is at "1". In contrast, when the lower keyboard is switched to the upper keyboard, the signal U/L is set to "0" from "1". In this case, when the signal U/L which is "0" is inputed into the first delay flip-flop 85, the preceding signal at "1" has been inputted into the next delay flip-flop 86. Therefore, two inputs applied to the EXCLUSIVE OR circuit 87 are "0" and "1", respectively, and therefore the output of the EXCLUSIVE OR circuit 87 is "1". When the state of the signal U/L is maintained unchanged, the two inputs to the EXCLUSIVE OR circuit 87 are at "0", or "1" and "1", and the output of the EXCLUSIVE OR circuit 87 is at "0". Thus, the output of the EXCLUSIVE OR circuit 87 has "1" only at the moment the keyboard selecting switch 15 is switched. This output "1" of the EXCLUSIVE OR circuit 87 is applied to the reset terminal of a counter 88 to reset the latter 88 to the all zero state.

The counter 88 is a 5-bit binary counter, and the outputs of the three most significant bits are applied to a NAND circuit 89. As will become more apparent from a description described later, all of the outputs of the three more significant bits are maintained at "1" and the output of the NAND circuit 89 is maintained at "0" until time immediately before the counter 88 is reset by the signal "1" of the EXCLUSIVE OR circuit 87. Accordingly, when the counter 88 is reset, the output of the NAND circuit 89 is raised to "1", and this output "1" is applied through a line 90 to an AND circuit 91 to enable the latter 91. A count pulse CT is applied to the other input terminal of the AND circuit 91 This count pulse CT has a pr period of the order of 3 milliseconds, and a pulse width substantially equals to that of the reset signal (being one period of the clock pulse $\phi$). After the counter 88 has been reset, the counter pulse CT is supplied to the counter 88, where it is counted. When the count value of the counter 88 reaches "1 1 1 0 0" (28 in decimal notation), the condition of the NAND circuit 89 is satisfied, and its output is set to "0" As a result, the AND circuit 91 is disabled, and thereafter no count pulse is applied to the counter 88.

The output of the NAND circuit 89 is maintained at "1" for a predetermined period of time after the counter 88 has been reset. This predetermined period of time is "28× (the period of the count pulse CT)", and is preferably approximately 100 milliseconds. This output "1" of the NAND circuit 89 is applied, as the clear pulse $CLR_1$, to the AND circuit 78 through the OR circuit 77. For the channel where a key has been released, $\overline{KO_1}=1$, and therefore the condition of the AND circuit 78 is satisfied, and the clear signal CLR is produced in response to the clear pulse $CLR_1$. By this clear signal CLR, the field effect transistor 73 (FIG. 4) is rendered conductive, as a result of which the capacitor $C_E$ is discharged instantaneously. Thus, the envelope waveform is cleared.

As is apparent from Table 2 described before, in this example, the relations between the block codes $B_1$–$B_3$ and the corresponding octave ranges of the upper keyboard is shifted just one octave from those of the lower keyboard. In the main tone generator section 13, the musical tones of the upper keyboard and of the lower keyboard are formed in different systems, and therefore the musical tone production is conducted in accordance with the relations indicated in Table 2. On the other hand, in the auxiliary tone generator section 14, the same device is used commonly for the upper keyboard and the lower keyboard, and therefore the relations as indicated in Table 2 cannot be obtained, unless some modification is applied thereto. For instance, if it is assumed that the octave selecting circuits 68 in the tone generators 18-1 through 18-7 are so designed as to select octave ranges according to the values of the block codes $B_1$–$B_3$ in the relation as indicated in the column UPPER KEYBOARD in Table 2, the upper keyboard tones may be produced with predetermined tone pitches, but the lower keyboard tones are produced in the octave ranges higher by one octave than the octave ranges having the predetermined tone pitches. Thus, the octave range of a lower keyboard tone (having the predetermined tone pitch as indicated in Table 2) provided by the main tone generator 13 is shifted by one octave from the octave range of the lower keyboard tone provided by the auxiliary tone generator 14 (although the same tone pitch key has been depressed). In the case where the octave selecting circuits 68 are so designed as to select the octave ranges as indicated in the column LOWER KEYBOARD of Table 2, the same problem as described above occurs with the upper keyboard. It is not always necessary to correct the shift of octave range described above, because it may impress the presence of te auxiliary tone generator section 14 and may give variation to the tones under performance. However, correction of the octave range of the tones of each keyboard which are provided by the auxiliary tone generator section 14 to the predetermined octave range can be readily achieved. That is, this can be accomplished by forming the decoder 22. (FIG. 4) with read only memories (ROM) so that the way of decoding the block codes $B_1$–$B_3$ for the upper keyboard is different from that for the lower keyboard. More specifically, the keyboard selection signal U/L from the keyboard selecting switch 15 is supplied through a line 92 (indicated by the broken line) to the decoder 22, and the input block code $B_1$–$B_3$ is decoded by the upper keyboard ROM when the signal U/L is at "0", while the input block code $B_1$–$B_3$ is decoded by the lower keyboard ROM when the signal U/L is at "1". If the decoder is arranged in this manner, the same block code $B_1$–$B_3$ can be decoded and supplied to the output lines ($oct_1$–$oct_5$) corresponding to different octave range separately according to the upper keyboard and the lower keyboard, as indicated in Table 2. Thus, the upper keyboard tones and the lower keyboard tones can be provided by the auxiliary tone generator section 14 in the same octave ranges as those in key depression in the respective keyboards.

In the example shown in FIG. 4, the tone generators 18-1 through 18-7 provide the 8-foot system (8'), 4-foot system (4') and 2-foot system (2') tones. These tones are merely shifted in tone pitch by the octave, and if their octave difference is disregarded, their interval relation is of the prime. Not only the tones of the prime but also the tones of the fifth such as $5\frac{1}{3}$-foot, ($5\frac{1}{3}'$), or $2\frac{2}{3}$-foot ($2\frac{2}{3}'$) register tones. In the case where it is required to produce the fifth system tones, it can be accomplished by designing the note selecting circuit 67 so that the relations between the note select signals NC#–NC and the notes of the tone source signals to be selected from the tone source signal bus 66 can select the notes of the fifth system. One example of the selection relations set in the note selecting circuit 67 is indicated in Table 3 below:

TABLE 3

| Note select signal | Note of Tone Source Signal to Be Selected: Prime (such as 16', 8', 4', 2' and 1') | Note of Tone Source Signal to Be Selected: Fifth (such as $5\frac{1}{3}'$ and $2\frac{2}{3}'$) |
|---|---|---|
| NC# | C# | G# |
| ND | D | A |
| ND# | D# | A# |
| . | . | . |
| . | . | . |
| . | . | . |
| NA# | A# | E |
| NB | B | F |
| NC | C | G |

In this case, the tone pitches of the fifth system tones must be increased in the order of G#, A, A# - - - E, F and G. However, since the block codes $B_1$–$B_3$ are set on the basis of the prime system, if a tone source signal of a certain among the tone source signals of the fifth system according to the block code $B_1$–$B_3$ set on the prime system, then the order of tone pitches becomes irregular. In order to overcome this difficulty, in the case where the octave of the tone source signals of the fifth register are selected, one (1) should be subtracted from or added to the value of the block code $B_1$–$B_3$ corresponding to a particular note. Then, the octave selection is carried out according to the thus changed block code $B_1$–$B_3$. For instance, in the case where, in the example of Table 3, the fifth system notes G#, A, A#, B and C should have an octave range lower by one octave, the requirement can can be satisfied by subtracting one (1) from the values of the block codes $B_1$–$B_3$ which are provided together with the note codes $N_1$–$N_4$ for the notes C#, D, D#, E and F. In the case where only the fifth system notes should be provided, it is unnecessary to partly change the block codes $B_1$–$B_3$ as described above, and instead the tone source circuit 65 may be so designed that the tone source signals generated thereby are suitable for the fifth system.

Figure 10:
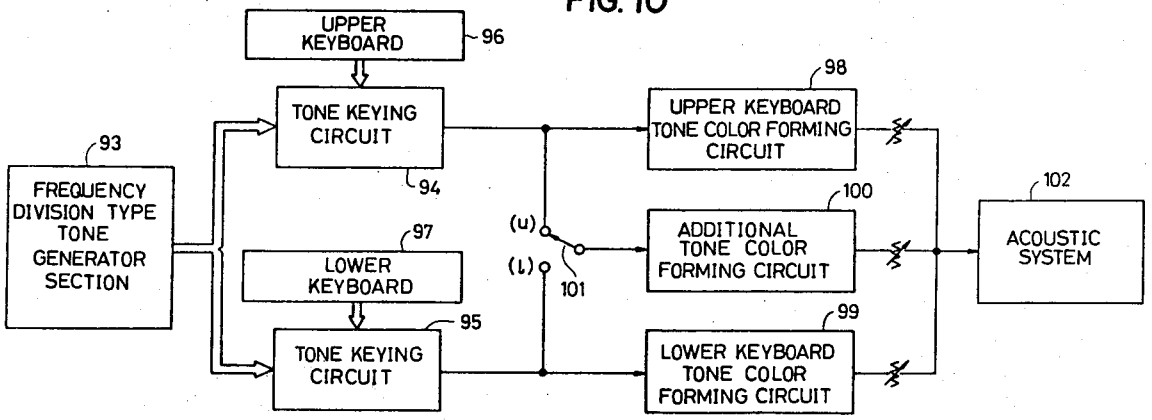
FIG. 10 is a block diagram showing another example of the electronic musical instrument according to the invention.

FIG. 10 shows another example of the electronic musical instrument of this invention, in which the technical concept of this invention is applied to a conventional analog type electronic musical instrument.

A frequency division type tone generator section 93 operates to provide submultiple frequency signals corresponding to all musical tone frequencies which can be produced by this electronic musical instrument, the submultiple frequency signals thus provided being applied to switching circuits 94 and 95. The outputs of the key switches of an upper keyboard 96 and a lower keyboard 97 are applied to the switching circuits 94 and 95, respectively, and the tone source signals of depressed keys are selected by the switching circuit 94 or 95. The tone source signals outputted by the switching circuits 94 and 95 are supplied to an upper keyboard's tone color forming circuit 98 and a lower keyboard's tone color forming circuit 99, respectively, where the musical tone forming (tone color forming) are carried out respectively for the upper keyboard and the lower keyboard. "An additional tone color forming circuit" 100 corresponding to the "additional musical tone generating circuit", which has been referred to in this invention is provided in parallel with the tone color forming circuits 98 and 99. The outputs of these tone color forming circuits 98, 99 and 100 are applied to an acoustic system.

A keyboard selecting switch 101 is provided at the input side of the "additional tone color forming circuit" 100. Where the switch 101 is set at the position u, the tone source signals from the upper keyboard's switching circuit 94 are applied to the tone color forming circuit 100. Where the switch 101 is set at the position l, the tone source signals from the lower keyboard's switching circuit 95 are applied to the tone color forming circuit 100. Thus, the "additional tone color forming circuit" 100 is used commonly for the upper keyboard and the lower keyboard by switching the switch 101.

If it is assumed that the upper keyboard's tone color forming circuit 98 forms the musical tones of piano tone color, the lower keyboard's tone color forming circuit 99 forms the musical tones of flute tone color, and the additional tone color forming circuit 100 forms the musical tones of clarinet tone color, then performances can be effected in the following combinations: If the keyboard selecting switch 101 is set for the upper keyboard (u), then piano tones and clarinet tones are produced by operating the keys of the upper keyboard, and flute tones are produced by operating the keys of the lower keyboard. If the keyboard selecting switch 101 is set for the lower keyboard (l), then piano tones are produced by operating the keys of the upper keyboard, and clarinet tones and flute tones are produced by operating the keys of the lower keyboard.

In the above-described example, the "additional tone color forming circuit" is used selectively for the upper keyboard and the lower keyboard; however, the invention is not limited thereto or thereby; that is, the additional tone color forming circuit may be used commonly for a plurality of keyboards.

What is claimed is:

1. In an electronic musical instrument having a plurality of keyboards and first musical tone generating means for generating musical tones corresponding to multibit binary coded key operation signals supplied from said keyboards, said signals specifying both the note name and the depressed and released state of the corresponding operated key, the improvement comprising:

a keyboard selecting switch, independent of the keys of said keyboard, for selecting one of said keyboards;

second musical tone generating means for generating musical tones corresponding to key operation signals; and key code distribution and latching means for gating to said second musical tone generating means only the binary coded key operation signals of said single keyboard selected by said keyboard selecting switch, said second musical tone generating means thereby generating musical tones in response to the gated binary coded key operation signals independently of and in addition to generation by said first tone generating means of musical tones in response to key operation signals of the same selected single keyboard.

2. An electronic musical instrument as claimed in claim 1 wherein said second musical tone generating means is polyphonic and includes plural tone generators for producing musical tones corresponding to the key operation signals from plural operated keys, each tone generator including a waveshape envelope circuit for separately establishing the amplitude envelope of the tone produced by the corresponding tone generator, said instrument further comprising:

envelope control circuit means, cooperating with all of said waveshape envelope circuits, for temporarily clearing the amplitude envelope of each musical tone provided by said second musical tone generating means when said keyboard selecting switch is operated.

3. An electronic musical instrument as claimed in claim 2, in which said envelope control circuit means comprises:

detection means for detecting the fact that the output of said switch is changed, and thereupon providing as an output a detection signal; and means for clearing the envelope waveform signals provided by said waveshape envelope circuits in said second musical tone generating means in response to said detection signal.

4. In a polyphonic electronic musical instrument having two or more keyboards, notes selected on said keyboards being represented by binary key codes, at least one time division multiplexed main tone generator section for generating musical tones, and a channel assignment circuit for assigning binary key codes representing keys selected on specific keyboards to certain time division multiplex channels dedicated to those keyboards, said main tone generator section receiving said time division multiplexed binary key codes and generating the musical tones corresponding to the assigned key codes, the improvement comprising:

keyboard selection means independent of the keys of said keyboard for selecting one of said keyboards, an auxiliary tone generator section for generating musical tones in response to binary key codes supplied thereto, and key code distribution and latching means for supplying to said auxiliary tone generator section only the key codes assigned to channels dedicated to the keyboard selected by said selection means, said auxiliary tone generator section thereby generating musical tones for the supplied key codes independently of and in addition to generation by said main tone generator section of musical tones for assigned key codes of the same selected keyboard.

5. An electronic musical instrument according to claim 4 wherein said auxiliary tone generator section comprises:

a plurality of individual tone generators each having a latch circuit for storing the key code representing a musical tone to be generated by that individual tone generator, all of the time division multiplexed key codes being supplied to each latch circuit, and wherein said distribution and latching means comprises:

a distribution control circuit, cooperatively connected to said keyboard selection means and synchronized with the time slots of said time division multiplex channels, for sequentially enabling the latch circuits in corresponding ones of said tone generators only during the time slots corresponding to the multiplex channels dedicated to the selected keyboard.

6. An electronic musical instrument according to claim 5 wherein each multiplex channel time slot is divided into two or more time intervals, wherein said channel assignment circuit provides a portion of each key code in two or more of said time intervals, and wherein said distribution and latching means further includes key data demodulating circuitry, receiving the apportioned key codes from said channel assignment circuit, for reassembling said apportioned key codes into complete key codes for utilization by said latch circuits.

7. An electronic musical instrument according to claim 5 wherein each key code is accompanied by a key-on signal indicating that the associated key is still selected, said auxiliary tone generator further comprising:

an envelope generator circuit in each tone generator, and an envelope control circuit, connected to all of said tone generators and cooperating with said keyboard selection means for rapidly damping all of the musical tones being generated by said tone generators when a different keyboard is selected by said key selection means.

8. In an electronic musical instrument having plural keyboards, the improvement comprising:

a tone generator section including a plurality of individual tone generators each having a respective envelope waveform generator for establishing the waveform of the musical tone generated by the corresponding tone generator, each tone generator producing a musical tone corresponding to selected key information provided thereto, said key information including an indication of key depression and release, each waveform generator cooperating with the associated tone generator to continue tone production with gradual decay after the provided note information indicates that the associated key has been released, keyboard selection switch means for selecting one of said plural keyboards and for providing to said tone generator section only the selected key information from that one selected keyboard, and a common envelope control circuit, connected to all of said waveform generators and cooperating with said keyboard selection switch means, for providing to all of said waveform generators a waveform clearance signal each time that a different keyboard is selected by said keyboard selection switch means, said waveform generators, in response to receipt of said waveform clearance signal, causing rapid damping of all musical tones which at the time of receipt of said waveform clearance signal were being produced with gradual decay.

9. An electronic musical instrument according to claim 8 wherein said selected key information comprises a binary key code indicating both note name and key-on condition, key information for plural selected keys being supplied in time division multiplex format, together with distribution means for providing to said tone generators only selected key information for keys in said one selected keyboard.

* * * * *